United States Patent [19]

Bretz

[11] 4,197,092

[45] Apr. 8, 1980

[54] HIGH PRESSURE COAL GASIFIER FEEDING APPARATUS

[75] Inventor: George M. Bretz, Verona, Pa.

[73] Assignee: Koppers Company, Inc., Pittsburgh, Pa.

[21] Appl. No.: 923,322

[22] Filed: Jul. 10, 1978

[51] Int. Cl.[2] ..... C10J 3/50

[52] U.S. Cl. ..... 48/86 R; 48/77; 48/87; 48/DIG. 4; 110/101 R; 110/104 R; 198/642; 414/195; 366/156; 366/157; 366/325; 415/72; 417/424

[58] Field of Search ..... 48/86 R, 87, 76, 77, 48/210, DIG. 4; 415/72, 73, 74; 417/424; 198/642; 366/156, 157, 169, 191, 317, 325; 110/101 R, 104 R; 214/17 C

[56] References Cited

U.S. PATENT DOCUMENTS

| | | | |
|---|---|---|---|
| 1,519,523 | 12/1924 | Young | 48/86 R |
| 2,934,476 | 4/1960 | Zvejnieks | 48/86 R |
| 3,235,231 | 2/1966 | Dietze et al. | 366/317 |
| 3,807,708 | 4/1974 | Jones | 415/72 |
| 3,997,146 | 12/1976 | Kline | 366/156 |

*Primary Examiner*—S. Leon Bashore
*Assistant Examiner*—George C. Yeung
*Attorney, Agent, or Firm*—R. Lawrence Sahr

[57] ABSTRACT

A centrifugal pump for feeding pulverized coal into a reactor of a high pressure coal gasification system is disclosed. The coal is pulverized and fed by conventional means into a hopper wherein that coal is mechanically pumped, by a modified screw which compacts the coal and releases entrained air and gases from that coal, to an impeller which serves to centrifugally sling the coal at high velocity into the reactor. Gases of the required type, pressure and quantity are combined with the coal at the point at which the coal is slung from the impeller in such a manner that the coal sufficiently dispersed and mixed with those gases and in proper form for gasification.

11 Claims, 7 Drawing Figures

HIGH PRESSURE COAL GASIFIER FEEDING APPARATUS

BACKGROUND OF THE INVENTION

1. Field of the Invention

This invention relates generally to the field of coal gasification and, more specifically, to apparatus for feeding coal into a reactor of a high pressure coal gasifier.

2. Background of the Prior Art

Efforts are being made to find substitutes for natural gas which has become in short supply and more costly. It has been proposed to produce gas from coal. One commercially available process involves the partial oxidation of coal entrained in steam and oxygen to form carbon monoxide and hydrogen, both of which are combustible gases.

In this process of coal gasification the entrainment is fed through a burner into a hollow chamber where the entrainment reacts exothermically at a high temperature in a flame-like reaction to produce gas consisting primarily of carbon monoxide and hydrogen which exits from the top of the reactor. At the elevated temperature at which this reaction occurs, slagging conditions prevail and the ash, as a molten fluid, exits from the bottom of the reactor. The gas is sent to other operations for further processing, and the molten ash falls into a hopper of water where the ash is quenched, solidified, and removed as a solid.

Heretofore, it has been customary to use a screw conveyor either to feed the finely ground coal to the reactor where it reacts with the blast of steam and oxygen, or to feed the coal, oxygen and steam as a mixture to the reactor. Typical feed means in accordance with the prior art are shown in Zellerhoff et al., U.S. Pat. No. 3,036,906, "Apparatus for Gasification of Finely-Divided Fuels", issued May 29, 1962; and Klapp, U.S. Pat. No. 3,104,020, "Apparatus for Gasification of Finely-Divided Solid Fuels", issued Sept. 17, 1963.

Recently, experimental efforts have indicated that the pressurization of the reactor significantly increases the efficiency of this type of gasification process. However, the pressurization of the reactor causes a problem in feeding the feedstock, or coal, into the reactor. Back pressure from the pressurized reactor creates a neutralizing turbulance to the flow of coal which is merely entrained in a stream of steam and oxygen. Thus, the coal particles tend to separate out of the integrated mixture and efficiency of the process drops. Means are required to counteract this phenomena such that a completely mixed and integrated flow of the correct proportions of steam, oxygen and coal can be introduced and evenly distributed, as such, within the pressurized reactor.

SUMMARY OF THE INVENTION

In accordance with this invention a centrifugal pump having a hollow feed shaft is provided for feeding the coal, steam and oxygen together into the gasification reactor as an entrainment. The housing of the pump has a generally tubular portion and a frusto-conical inner end portion. An impeller is rotably mounted in said housing. The impeller has a generally frusto-conical end portion which mates with the inner surface of the inner end portion of the housing. The frusto-conical impeller portion has a series of sprues forming a fluted surface. The sprues extend longitudinally from the frusto-conical section which, in cooperation with the inner surface of the inner end portion of the housing, form pockets for pumping the coal toward the periphery of the impeller. The impeller is hollow and includes means for feeding gas through the hollow portion to the periphery of the impeller. The coal and the gases strike a slinger plate, that is adjacent to the impeller, or a portion of the impeller, and which rotates with the impeller, causing the coal and the gases to flow outwardly radially so as to mix and be dispersed by a combination of centrifugal force and released gas pressure.

For further understanding of the invention and for features and advantages thereof, reference may be made to the following description and the drawings which illustrate preferred embodiments of equipment in accordance with the present invention.

DETAILED DESCRIPTION

Figure 1:
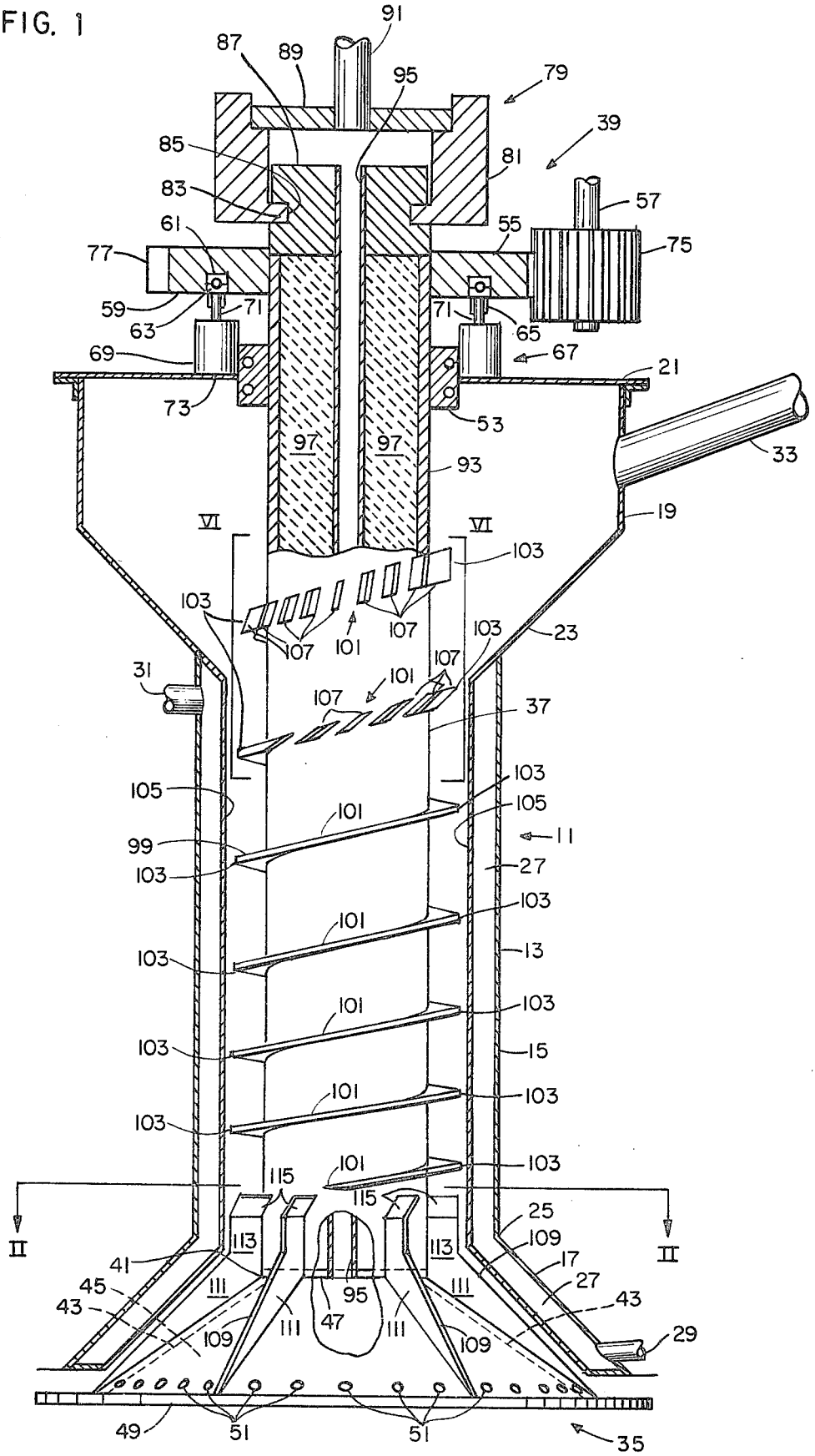
FIG. 1 is a cut-away elevational view of the preferred embodiment of the feeder according to the present invention.

Referring to FIG. 1, there is illustrated a centrifugal pump, generally designated by the numeral 11. The outer housing 13 of the centrifugal pump 11 consists of a water-cooled cylindrical jacket 15 bounded at the bottom by a water-cooled impeller housing 17 and at the top by a hopper 19. The hopper 19 is enclosed by a hopper cover 21. The hopper bottom 23, adjacent the cylindrical jacket 15, is frusto-conical, providing an inclined plane upon which matter deposited in the hopper 19 can gravitate toward the cylindrical jacket 15. The impeller housing 17 is also frusto-conical, flaring outwardly from its juncture 25 with the bottom of the cylindrical jacket 15. The impeller housing is also water-cooled, the cooling passageway 27 being contiguous with that of the cylindrical jacket 15 and continuous in the well-known radial manner. Baffles, not shown, may be incorporated into the cooling passageway 27 to insure a radial spiral flow of rapidly moving water from the high pressure cooling water inlet 29 to cooling water outlet 31. It is also possible to use other cooling fluids besides water, circulating through the cooling passageway. These alternate fluids may be either liquid or gaseous.

As shown in FIG. 1, there is an input conduit 33 interposed through the wall of the hopper 19. Through this input conduit 33 material moves into the hopper. The material so moving may be motivated by any well-known motivation device, not shown, for example, a rotary flight conveyor. The material being so moved is a pulverized solid; in the preferred embodiment, coal pulverized to about 70% minus 200 mesh. It is important in the operation of the present invention to maintain pulverized material in the hopper 19 at all times during the operation of the apparatus herein described.

Interposed within the outer housing 13 of the centrifugal pump 11 and arranged about the central axis thereof is, in order from bottom to top as shown in FIG. 1, an impeller, generally designated by the numeral 35, a drive shaft 37 connected to the impeller 35, and a drive mechanism, generally designated by the numeral 39.

The impeller is frusto-conical in shape, flaring downwardly and outwardly from the connection 41 thereof to the drive shaft 37. As indicated by the interior wall 43 dotted lines in FIG. 1, the impeller 35 is hollow, the interior cavity 45 being similar to the frusto-conical outer shape. The connection 41 between the impeller interior cavity 45 and the drive shaft 37 is formed by a divider plate 47. The bottom of the impeller 35 is formed by a slinger 49 which is larger in diameter than the largest cross section of the frusto-conical portion of the impeller 35. Gas discharge nozzles 51 extend through the periphery of the impeller 35 from the interior cavity 45 at about the largest cross section of the frusto-conical portion of the impeller 35, just above and adjacent to the slinger 49. These discharge nozzles 51 are equally spaced apart in the preferred embodiment but, alternately, may be grouped or clustered. The gas discharge nozzles in the preferred embodiment are slightly tapered, in the form of a frusto-conical section, the smaller diameter of which is on the interior wall 43.

The drive shaft 37 is uniformly cylindrical in shape, extending upwardly from the impeller 35 through the cylindrical jacket, the hopper 19 and hopper cover 21. A water-cooled bearing 53 is used to rotatably mount the drive shaft through the hopper cover 21. The bearing 53 is fixed through the hopper cover 21 and the drive shaft 37 rotates within the bearing.

Above the bearing 53, a bull gear 55 is fixed to the drive shaft 37. The bull gear 55 is rotatably driven by a powered pinion 57. The bull gear 55 along with the powered pinion 57 form the drive mechanism 39 in the preferred embodiment; however, other types of rotary drives may be used, if preferred.

On the bottom surface 59 of the bull gear 55 a groove 61 is uniformly cut, into which is inserted a ball-type thrust bearing 63 of conventional design. Directly beneath the lower race 65 of the thrust bearing 63 is centered a positioning system, generally designated by the numeral 67. In the preferred embodiment the positioning system consists of several upright double acting hydraulic cylinders 69. In FIG. 1, two hydraulic cylinders 69 are shown but at least three are required, equally spaced directly beneath the lower race 65. The extendible rods 71 of the hydraulic cylinders 69 are pivotably mounted to the lower race 65. The hydraulic cylinder bases 73 are mounted to the hopper cover 21. The purpose of the positioning system 67 is twofold: Firstly, it serves to vertically raise and lower the drive shaft 37 and, consequently, the impeller 35 connected thereto. Secondly, it serves to adjust the angle between the common axis of the drive shaft 37 and impeller 35 with respect to the axis of the outer housing 13 within a limited arc. Hydraulic power means, not shown, serves to operate the hydraulic cylinders 69 in the preferred embodiment. Alternate positioning systems 67 may be used as, for example, jack screws. It will be noted from viewing FIG. 1 that the powered pinion 57 has a gear face 75 that is longer than the gear face 77 of the bull gear 59. This arrangement provides vertical movement of the drive shaft 37 without the bull gear 59 and the powered pinion 57 becoming disengaged.

The uppermost portion 87 of the drive shaft 37 is provided with a rotary seal, generally designated by the numeral 79. In the preferred embodiment, the rotary seal 79 includes a body 81 with an inner lip 83, about as shown in FIG. 1. The inner lip is machined to precision fit a recess 85 machined into the uppermost portion 87 of the drive shaft 37. A disc 89 is fitted in a gas-tight manner to the body 81 of the rotary seal 79. In the preferred embodiment, the disc 89 is interference press fitted into the body 81, although other methods, for example, welding the disc 89 into the body 81, will provide a gas-tight fit. Through the center of the disc 89 is a gas inlet 91. The gas inlet 91 is connected to a flexible conduit, not shown, to allow movement of the drive shaft 37. The body 81 of the rotary seal 79 remains stationary while the drive shaft 37 rotates.

In the preferred embodiment, as shown in FIG. 1, the drive shaft 37 is composed of a hollow tube 93 with the uppermost portion 87 being in the form of a cap fixed to the upper end of the tube 93. The lower end of the tube 93 is sealed by divider plate 47. Gas channel 95 traverses the longitudinal length of the uppermost portion 87, the tube 93 and the divider plate 47, respectively, from top to bottom, commencing within the rotary seal 79 and terminating within the interior cavity 45. The space between the gas channel 95 and the tube 93 is filled with a lightweight conventional refractory material 97 to diminish heat transfer from the impeller 35 up to the water-cooled bearing 53.

Surrounding the drive shaft 37 is a spiral flute 99 which begins at its upper end at about the point of height where the largest diameter of the frusto-conical section of the hopper bottom 23 is positioned, as shown in FIG. 1. From its upper end, the spiral flute 99 traces a modified circumferential path several times around the drive shaft 37 toward the lower end of the cylinder jacket 15. The angle of inclination of the spiral flute 99 with respect to the horizon decreases continuously from top to bottom, and each successive flight 101 of the spiral flute 99 is increasingly larger in diameter than the one above. Viewing the spiral flute 99 as shown in FIG. 1, the edges 103 thereof track the outline of a frusto-conical section rather than being parallel, those edges 103 being closer to the interior sides 105 of the cylindrical jacket 15 near its bottom than at its top. Also, the distance between each of the flights 101 decreases going from top to bottom of the spiral flute 99.

Figure 6:
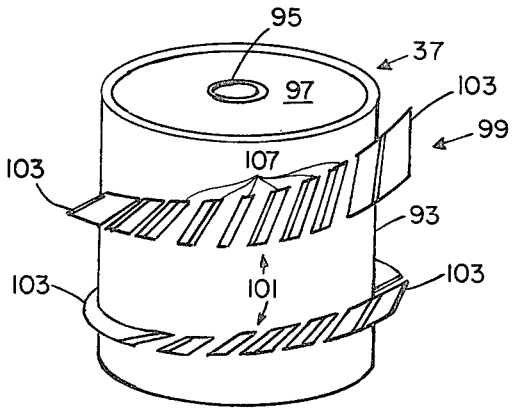
FIG. 6 is an enlarged isometric projection of section VI—VI of the impeller shaft as viewed in FIG. 1.

In the preferred embodiment, as shown in FIGS. 1 and 6, the top two flights 101 of the spiral flute 99 are arranged in the form of paddles 107 as opposed to an unbroken continuum as found in the balance of the spiral flute 99. The angle of each of the successive paddles 107, in respect to the vertical, increases, beginning with the uppermost point of the spiral flute 99 and tracking down around the drive shaft 37 through the second flight 101, as shown in FIGS. 1 and 6. The distance separating the paddles 107, each from the next adjacent one, decreases from that beginning uppermost point, tracking around down through the second flight 101. Also, the length of each successive paddle 107 decreases tracking from that uppermost point down around through the second flight 101. At the lowest point of the second flight 101 the unbroken continuum of the balance of the spiral flute 99 begins. The purpose of this arrangement of paddles 107 is to further pulverize any larger pieces of coal that might be in the hopper 19, blending the so pulverized larger chunks with the balance of the coal, and to allow the escape of air and gas trapped or entrained within the pulverized mass of the coal. The purpose of the spiral flute 99 is to mechanically convey, with increased compaction and bulk density, the coal from within the hopper 19 down through the cylindrical jacket 15 to the area of the impeller 35.

Figure 2:
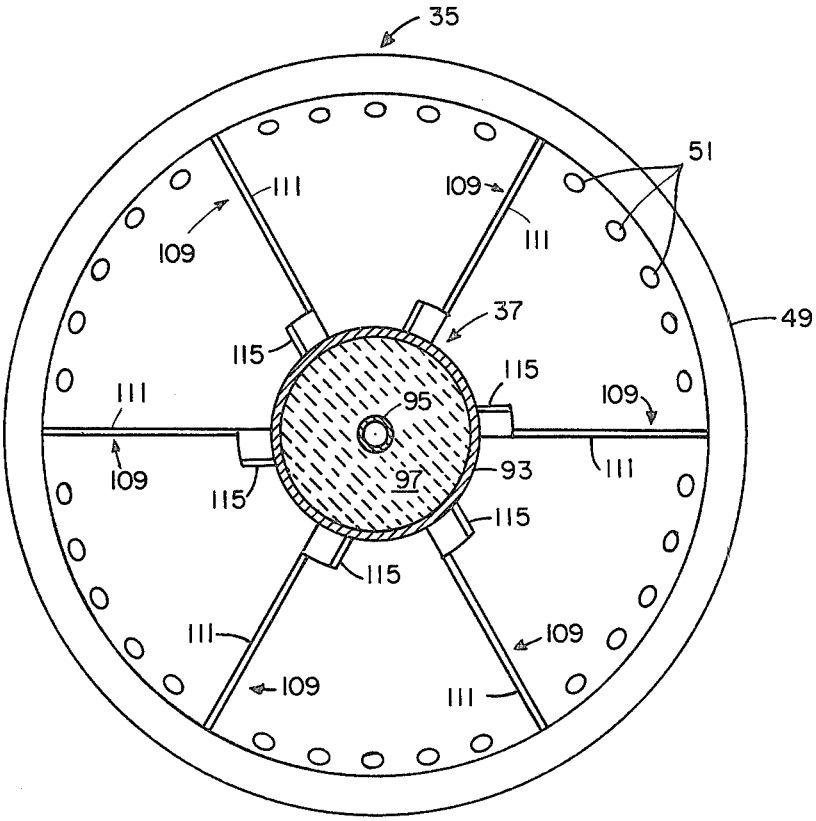
FIG. 2 is a plan view of the impeller of the preferred embodiment of the feeder as viewed from II—II of FIG. 1.

As shown in FIGS. 1 and 2, vanes 109 are arranged equidistantly around the impeller 35, the space between the vanes 109 bounded by the impeller housing 17 and the impeller 35 being defined as sprues. The included angle of the impeller housing 17 is less than the included angle of the impeller 35. The lower section 111 of a given vane 109 is tapered in an angle about equivalent to one half of the difference between the included angle of the impeller 35 and the included angle of the impeller housing 17, as shown in FIG. 1. The taper angle of the lower section 111 decreases from top to bottom of the impeller 35, thus the cross-sectional areas and volumes of the sprues decrease accordingly from top to bottom. The upper section 113 of the vanes 109 is uniform in width, and the arrangement thereof substantially fills the gap between the drive shaft 37 and the interior side 105 of the cylindrical jacket 15, the upper sections 113 extending upward from the lower sections 111 along the sides of the drive shaft 37 to about the lower end of the spiral flute 99, as shown in FIG. 1. The upper tips 113 of the upper section 113 is canted toward the direction of incline of the flights 101 of the spiral flute 99 in respect to the lower end thereof to provide a transition for coal moving downwardly through the spiral flute 99 into the sprues.

The drive shaft 37 is rotated by the drive mechanism 39 such that the uppermost end of the spiral flute 99 leads while the lowermost end of the spiral flute 99 follows. As viewed in FIG. 2, the direction of rotation is counterclockwise.

Figure 3:
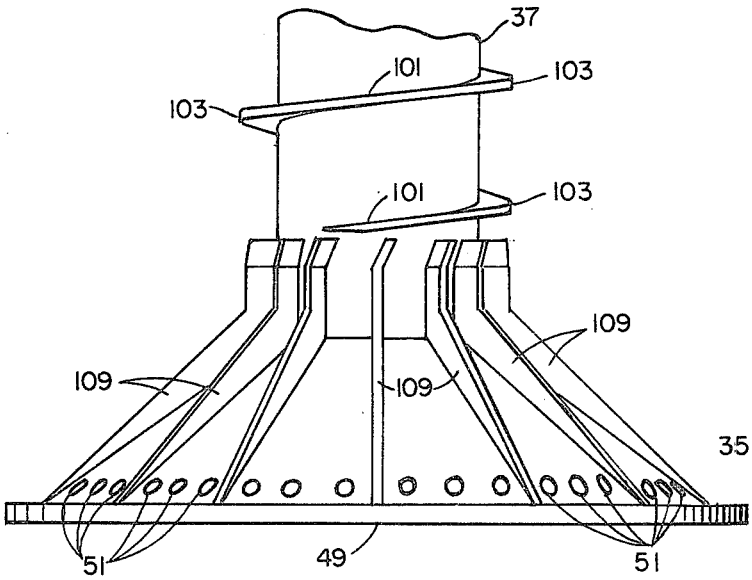
FIG. 3 is a cut-away elevational view of an alternate embodiment of the impeller according to the present invention.

In the preferred embodiment, as shown in FIGS. 1 and 2, there are six vanes 109 on the impeller 35. Alternately, additional vanes 109 can be employed on the impeller 35, as shown in FIG. 3, as well as additional gas discharge nozzles 51. Of course, such an alternate embodiment would have additional sprues having a lesser width. All other aspects of this alternate impeller 35 embodiment would be substantially identical to those of the preferred embodiment as described and shown in FIG. 1.

Figure 7:
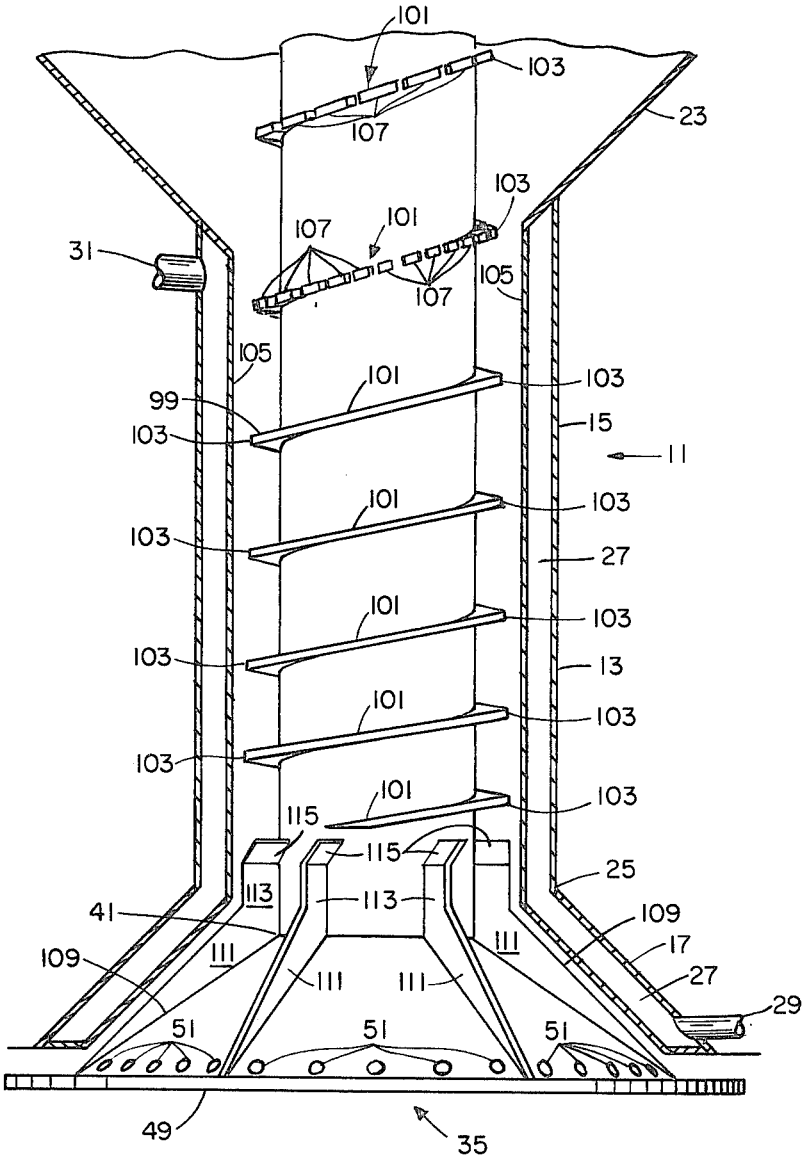
FIG. 7 is a cut-away elevational view of an alternate embodiment of the impeller shaft according to the present invention.

FIG. 7 illustrates an alternate arrangement of the paddles 107, the significant difference being that in this embodiment the angle of each of the paddles is identical to and tracks the general angle of the spiral flute 99 as distinguished from being offset to various degrees from the vertical as in the preferred embodiment shown in FIGS. 1 and 6.

One or more of the centrifugal pumps 11 are fixed extending through the top or top section of a pressurized reactor in which carbonaceous material is gasified. In the preferred embodiment, coal is the carbonaceous material and the reactor would be generally of the design known to those skilled in the art as the Koppers-Totzek design. The centrifugal pumps 11 could be used in combination with the heads generally utilized in Koppers-Totzek gasifiers or, preferably, the heads would be eliminated, thus providing the centrifugal pumps 11 as the sole source of introducing the feedstock and required gases.

In operation, pulverized coal is fed into the hopper 19 through the input conduit 33 at a rate sufficient to maintain a constant level within the hopper 19 above the spiral flute 99. The drive mechanism 39 rotates the drive shaft 37 in a direction in which the uppermost edge of the spiral flute 99 leads, as explained previously. The coal is conveyed downwardly as entrained air and gases escape. The design of the spiral flute 99, as explained previously, compacts the coal, increasing its bulk density as it is conveyed downwardly. As the coal reaches the lower end of the spiral flute 99, it enters the sprues where it is forced into a more compact form. The compacting pressure on the coal forms a moving seal between the coal, the impeller 35 and the impeller housing 17 which prevents the high pressure in the reactor from escaping up along the drive shaft 37 into the hopper 19. The moving seal also acts as a bearing surface between the impeller 35, the vanes 109, and the impeller housing 17, tending to center the impeller 35 within the impeller housing 17.

As the coal is moving downwardly, gas is being fed, under pressure, through the gas inlet 91 and down through the gas channel 95 into the interior cavity 45 of the impeller 35. In the preferred embodiment, the gas utilized is a mixture of steam and oxygen, necessary for gasification to take place in a Koppers-Totzek gasifier. Alternate embodiments could utilize a relatively inert gas, such as carbon dioxide, with the introduction of steam and oxygen at another point in the reactor. Or, when the centrifugal pump 11 is applied to other types of gasifiers, steam and oxygen may be eliminated with only a utilization of a relatively inert gas present.

The rotation of the impeller 35 imparts a centrifugal force to both the coal within the sprues and the gas within the interior cavity 45 of the impeller 35. As the coal reaches the slinger 49, situated at a lower level than the lowest end of the impeller housing 17, the centrifugal force propels the coal outwardly in the plane of the slinger 49, thus converting static centrifugal force to dynamic centrifugal force. Concurrently, the already pressurized gas, which is further energized by the static centrifugal force, exits the interior cavity 45 through the gas discharge nozzle, intimately mixing with and finely dividing the coal. The rotating motion of the impeller 35 also converts the static centrifugal force of the gas to dynamic centrifugal force. The mixture is evenly dispersed throughout the reactor where the coal is gasified. The use of centrifugal force to disperse the mixture, rather than a sole relience on gas pressure, counteracts the pressure gas flow turbulence caused by the gasification of coal within the reactor. Thus the gasification is prevented from becoming zone localized within the reactor but, instead, uniform overall gasification is therein promoted.

The pressurized gas, further energized by the centrifugal force, serves an additional function. The high compacting forces coupled with an elevated temperature, that are imparted to the coal in the vicinity of the impeller 35, tends to produce some slight agglomeration of the coal. The gas which exits the gas discharge nozzles 51 breaks up this agglomeration, reducing the coal to its completely pulverized state. Thus, what is being introduced to the reactor is analogous to atomized coal in an ideal form for gasification.

Figure 4:
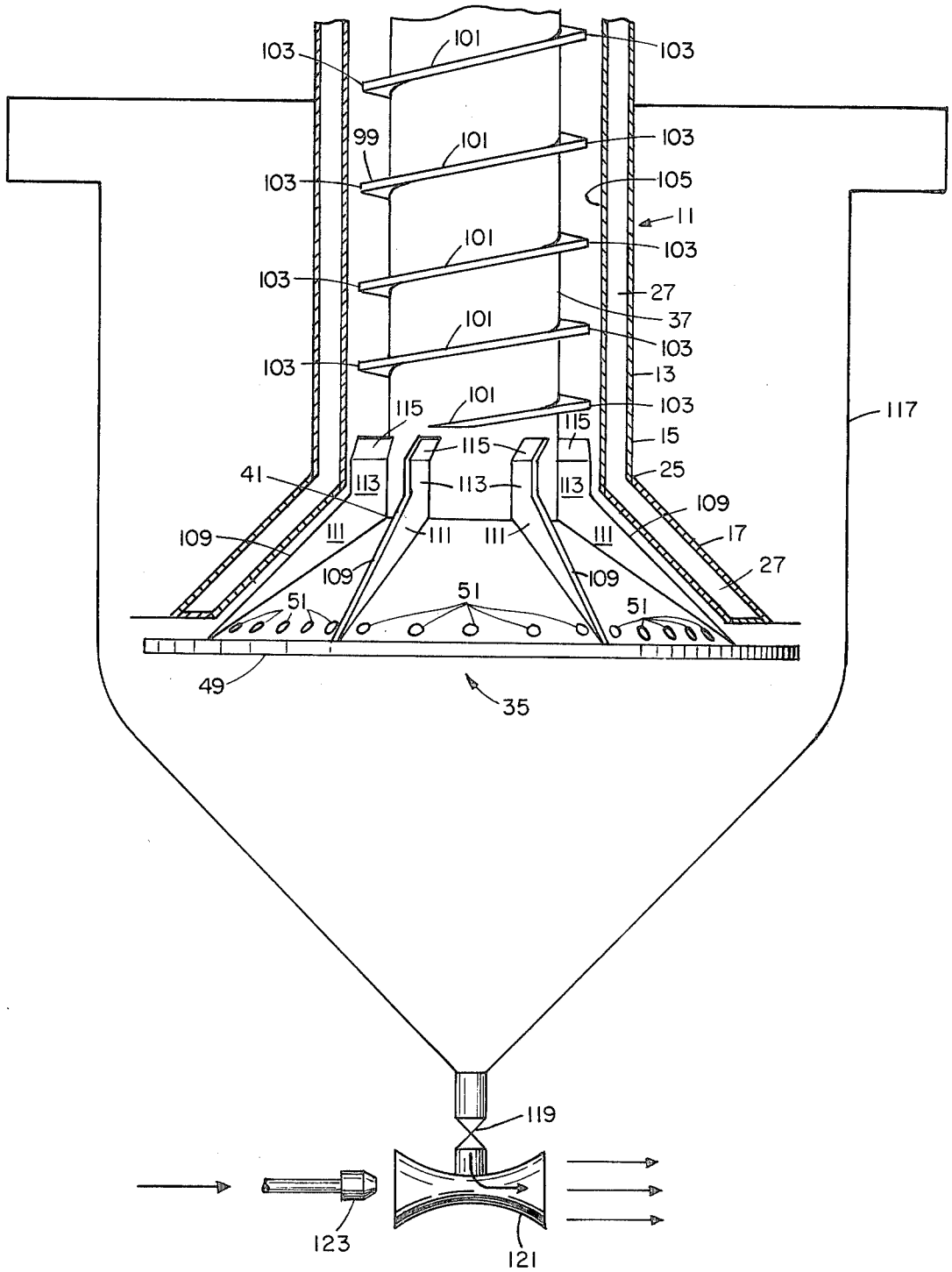
FIG. 4 is a schematic representation of a first alternate embodiment of the feeder according to the present invention.

The centrifugal pump 11 can be used in a first alternate embodiment to introduce atomized coal into a high pressure plenum chamber 117, as shown in FIG. 4. In this application a relatively inert gas, such as carbon dioxide, is used to atomize the coal. The coal is then fed selectively by way of a valve 119 to an ejector jet 121 where a combination of steam and oxygen are added from a motive gas nozzle 123, the mixture being expelled, or fed, into a reactor. The valve 119 is used to control the quantity of atomized coal being mixed with a given quantity of steam and oxygen.

Figure 5:
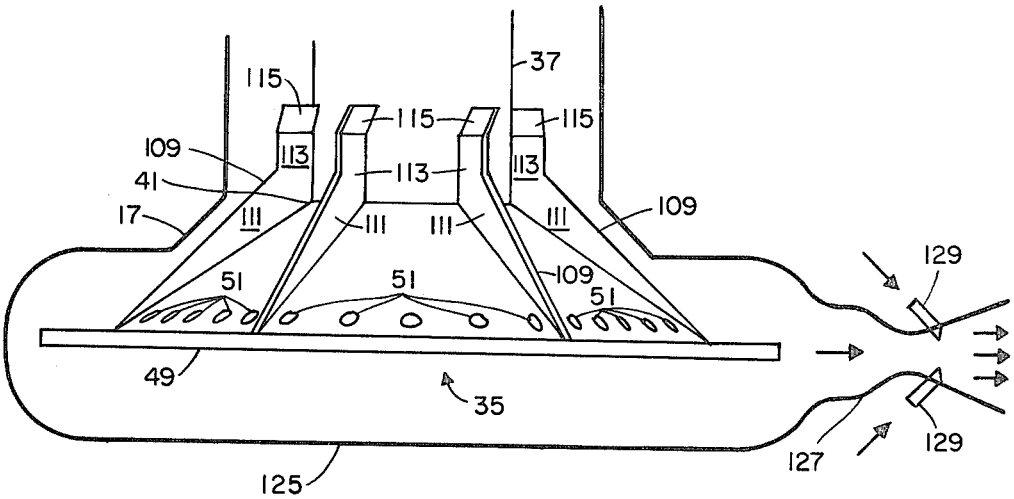
FIG. 5 is a schematic representation of a second alternate embodiment of the feeder according to the present invention.

A second alternate embodiment, shown in FIG. 5, provides an enclosed flow chamber 125 which is continuous with and extending from the bottom of the impeller housing 17. An ejector jet 127 is positioned to provide an outlet about where shown in FIG. 5. In this embodiment the atomized coal entrains steam and oxygen with it as it moves through the ejector jet 127, the oxygen and steam being introduced through nozzles 129 mounted into the ejector jet 127 about where shown in FIG. 5. The coal-steam-oxygen mixture is introduced to the reactor upon exit from the ejector jet 127.

According to the provisions of the patent statute, the principle, the preferred embodiment, and the mode of operation of the present invention have been illustrated and described, along with alternate embodiments thereof. However, it is to be understood that within the scope of the appended claims the present invention may be practiced otherwise than as specifically illustrated and described.

What is claimed is:

1. A centrifugal pump operable to feed carbonaceous material and gases to a reactor, where the pressure within the reactor is higher than the ambient pressure, comprising:

(a) a housing;

(b) means for conducting carbonaceous material into said housing;

(c) a drive shaft centrally positioned within said centrifugal pump (d) a spiral flute fixed radially to and surrounding at least a portion of said drive shaft;

(e) means for rotating said drive shaft in a direction such that said spiral flute moves said carbonaceous material in a set direction from one position to another within said centrifugal pump; said spiral flute being arranged to include a plurality of spaced-apart sections of the lead end thereof; said spiral flute also being arranged in such a way that each flite of said spiral flute, beginning at said lead end, is spaced closer to the next succeeding flite than to the next previous flite;

(f) an impeller, the first end of which is fixed to the end of and aligned with the axis of rotation of said drive shaft, said impeller containing an interior cavity;

(g) a slinger fixed to the second end of said impeller;

(h) means for conducting gases under elevated pressure into said interior cavity of said impeller, said means for conducting which maintains said gases separate from said carbonaceous material until said gases pass from said interior cavity of said impeller;

(i) conduit means extending from said interior cavity of said impeller to the exterior thereof adjacent to said slinger, for combining said gases with said carbonaceous material.

2. The invention described in claim 1 further comprising said spiral flute having successive edges which increase in diameter such that said edges track a frusto-conical section having its smallest diameter at the lead end of said spiral flute and its largest diameter at the trailing end of said spiral flute.

3. The invention described in claim 1 wherein said housing comprises:

(a) a hopper positioned to surround said drive shaft located about that section of said drive shaft which is remote from said impeller;

(b) a hopper cover connected to the first end of said hopper, surrounding and sealing the end section of said drive shaft which is remote from said impeller, to prevent the escape of said carbonaceous material from said hopper adjacent said end of said drive shaft which is remote from said impeller;

(c) a tubular jacket fixed to the second end of said hopper opposite said hopper cover, and extending from said second end of said hopper, positioned about the axis of said drive shaft and surrounding said spiral flute; and (d) an impeller housing in the form of a frusto-conical section extending from said the end of said tubular jacket opposite said hopper, the included angle of said frusto-conical section of said impeller housing being less than the included angle of said frusto-conically shaped impeller, positioned to symetrically surround said impeller, said impeller housing terminating spaced apart from said slinger.

4. The invention described in claim 3 further comprising a plurality of vanes longitudinally mounted to said impeller, spaced apart equally thereon, each of said vanes being substantially triangular in shape, said triangle shape being substantially equal in size to the triangular gap formed between said impeller and said impeller housing, each of said vanes tapering away from said slinger, being greatest in width at said abutment of said impeller and said drive shaft, each of said vanes extending longitudinally along said drive shaft from said impeller to a section of said drive shaft adjacent to said trailing end of said spiral flute, the ends of said vanes most proximate to said trailing end of said spiral flute being canted from the longitudinal toward the direction of the angle of the spiral of said spiral flute, said ends providing means for the transition of movement of said carbonaceous material past said spiral flute down into the sprues, each of which is defined by two adjacent vanes, the impeller and the impeller housing.

5. The invention described in claim 1 further comprising:

(a) a plenum chamber, extending from said housing, into which said compacted material combined with said gases under elevated pressure are deposited by said means for slinging and atomizing;

(b) valve means operable to release varying quantities of said slung and atomized compacted material combined with said gases under elevated pressure from said plenum chamber; and (c) gas entrainment and motivation means operable to entrain additional gas in and feed said varying quantities of said slung and atomized compacted material combined with said gases under elevated pressure, released by said valve means from said plenum chamber, into said reactor.

6. The invention described in claim 1 further comprising:

(a) a flow chamber, extending from said housing, into which said slung and atomized compacted material combined with said gases under elevated pressure are fed by said means for slinging and atomizing;

(b) ejector jet means, providing an outlet from said flow chamber, directing said slung and atomized compacted material combined with said gases under elevated pressure from said flow chamber into said reactor; and (c) means, for entrainment of additional gases into said slung and atomized compacted material combined with said gases under elevated pressure, operable with said ejector jet means.

7. The invention described in claim 1 wherein said housing includes means for water cooling thereof.

8. The invention described in claim 3 further comprising means for longitudinally moving said drive shaft so as to move said impeller away from and towards said impeller housing, thereby increasing and decreasing, respectively, said gap between said impeller and impeller housing to adjust the rate of movement of said carbonaceous material through said sprues.

9. The invention described in claim 1 wherein said impeller is frustaconically shaped, the smaller diameter of which is the first end thereof and is which is equal to and abutted against the said end of said drive shaft and wherein said slinger forms a cup for the larger diameter of said slinger, the second end thereof, thus enclosing said interior cavity of said impeller.

10. The invention described in claim 1 wherein the conduit means, extending from said interior cavity of said impeller to the exterior thereof adjacent to said slinger, comprises a plurality of gas discharge nozzles located peripherally upon said impeller, being generally evenly spaced thereabout.

11. A centrifugal pump operable to feed carbonaceous matter, particularly pulverized coal, and gases to a reactor, where the pressure within the reactor is higher than ambient pressure, comprising:

(a) a housing comprising:
  (i) a hopper;
  (ii) a hopper cover connected to the first end of said hopper;
  (iii) a tubular jacket fixed to the second end of said hopper and extending therefrom; and
  (iv) an impeller housing in the form of a frustoconical section extending from the end of said tubular jacket opposite said hopper;

(b) means for conducting said carbonaceous material into said hopper;

(c) a drive shaft centrally positioned within said centrifugal pump, extending through said hopper and said hopper cover, said hopper cover surrounding and sealing the first end section of said drive shaft to prevent the escape of said carbonaceous material from said hopper adjacent said first end of said drive shaft, said drive shaft extending through said tubular jacket along the central axis thereof;

(d) a spiral flute fixed radially to and surrounding at least a portion of said drive shaft, said spiral flute having successive edges which increase in diameter such that said edges track a frustoconical section having its smallest diameter at the lead end of said spiral flute and its largest diameter at the trailing end of said spiral flute, said spiral flute being arranged in such a way that each flight of said spiral flute, beginning at the lead end thereof, is spaced closer to the next succeeding flight than to the next previous flight, at least one flight of said spiral flute, beginning at the lead end thereof, comprising spaced-apart non-continuous sections arranged to release gases which are entrained in said carbonaceous material prior to being conducted into said centrifugal pump;

(e) means for rotating said drive shaft connected in driving relation to said drive shaft;

(f) an impeller, mounted to the second end of said drive shaft, and rotatably mounted within said centrifugal pump and aligned with the axis of rotation of said drive shaft, said impeller which is frustoconically shaped, the smaller diameter of which is equal to and abutted against the said second end of said drive shaft, said impeller containing an interior cavity generally shaped as said impeller is shaped, said impeller being hollow, the included angle of said frustoconical shape of said impeller being greater than the included angle of said frustoconical section of said impeller housing, said impeller housing being positioned to symmetrically surround said impeller;

(g) a slinger fixed to and capping the larger diameter of said impeller, said slinger being aligned with the axis of rotation of said impeller;

(h) a plurality of gas discharge nozzles forming conduits from said interior cavity of said impeller to the exterior of said cavity, located peripherally upon said impeller, adjacent to said slinger, and being generally evenly spaced apart thereabout;

(i) a gas channel traversing through the length of said drive shaft positioned about the axis of rotation of said drive shaft and opening into said interior cavity of said impeller;

(j) a plurality of vanes longitudinally mounted on said impeller, spaced apart equally thereon, each of said vanes being substantially triangular in shape, said triangle shape being substantially equal in size to the triangular gap formed between said impeller and said impeller housing, each of said vanes tapering away from said slinger, being greatest in width at said abutment of said impeller and said drive shaft, each of said vanes extending longitudinally along said drive shaft from said impeller to a section of said drive shaft adjacent to said trailing end of said spiral flute, the end of said vanes most proximate to said trailing end of said spiral flute being canted from the longitudinal toward the direction of the angle of the spiral of said spiral flute, said ends providing means for the transition of movement of said carbonaceous material past said spiral flute down into the sprues, each of which is defined by two adjacent vanes, said impeller and said impeller housing;

(k) means, operable upon said drive shaft, for longitudinally moving said drive shaft and impeller away from and towards said impeller housing, thereby increasing and decreasing, respectively, said gap between said impeller and said impeller housing.

* * * * *